United States Patent [19]

Olivieri

[11] Patent Number: 4,684,140

[45] Date of Patent: Aug. 4, 1987

[54] EXTENDIBLE ROLLER SKATE

[75] Inventor: Oliviero Olivieri, Montebelluna, Italy

[73] Assignee: Icaro Olivieri & C. S.p.A., Treviso, Italy

[21] Appl. No.: 880,646

[22] Filed: Jun. 27, 1986

Related U.S. Application Data

[63] Continuation of Ser. No. 551,558, Nov. 14, 1983, abandoned.

[30] Foreign Application Priority Data

Nov. 24, 1982 [IT] Italy ..... 23528/82[U]

[51] Int. Cl.[4] ..... A63C 17/02

[52] U.S. Cl. ..... 280/11.26; 403/108; 403/110

[58] Field of Search ..... 280/11.16, 11.26; 403/106, 107, 108, 109, 110

[56] References Cited

U.S. PATENT DOCUMENTS

| | | | |
|---|---|---|---|
| 526,655 | 9/1894 | Johnson | 280/11.16 |
| 1,807,890 | 6/1931 | Berger | 280/11.26 |
| 3,007,706 | 11/1961 | Pullen | 280/11.26 |
| 3,432,197 | 3/1969 | Albertine | 403/110 |

FOREIGN PATENT DOCUMENTS

| | | | |
|---|---|---|---|
| 506440 | 10/1951 | Belgium | 403/107 |

*Primary Examiner*—John J. Love
*Assistant Examiner*—Richard Camby
*Attorney, Agent, or Firm*—Birch, Stewart, Kolasch & Birch

[57] ABSTRACT

An extendible roller skate has a support structure constituted by two mutually telescopic parts. Releasable fixing means are provided for securing the support-structure parts in fixed relative positions corresponding to a desired length of skate. These fixing means comprise a series of notches provided on one support-structure part, and a cooperating toothed member mounted on the other part of the support structure. This toothed member is mounted for movement towards and away from the notches of the notched support-structure part, movement towards the notches being opposed by a spring. A cam-shaped lever is provided to press the toothed member into engagement with the notches. Operation of this lever enables the rapid securing together and release of the two parts of the support structure.

7 Claims, 4 Drawing Figures

EXTENDIBLE ROLLER SKATE

This application is a continuation of application Ser. No. 551,558 filed on Nov. 14, 1983, now abandoned.

FIELD OF THE INVENTION

The present invention relates to a roller skate having an extendible type of structure.

BACKGROUND OF THE INVENTION

It is known that roller skates of the said type have support structures that are basically constituted by two parts which are mutually telescopically engaged by means, for example, of the sliding coupling of cooperating prismatic guide elements. It is also known that once the desired length of the skate has been set, the said two parts of the support structure are mutually fixed together by means of one or more nut and bolt combinations. In other cases and in order to increase the clamping force between the two parts when fixed together in their desired positions, it has been proposed to replace the nut of the nut and bolt combination by a suitably dimensioned transverse plate having fine teeth on one of its faces for engaging corresponding teeth formed in one of the parts of the skate structure.

These fixing systems although widely used and advantageous from several points of view, suffer from a drawback of a technical nature which has not been overcome until now. Thus, for example, during sports use it is well known that the skate is subject to considerable forces and particularly to strong and prolonged vibrations which can quickly lead to a permanent, or at least a dangerous, mutual disengagement of the fixing means. On the other hand, it is also easy to find the opposite situation arising in which the nut and bolt become locked together, for example, due to the formation of roughness in the coupling or due to deformation.

Moreover, the adjustment of the length of the skate is always laborious due to the manipulation of each nut and bolt combination, the tightening of which always requires the use of a suitable tool.

The main object of the present invention is to provide an extendible roller skate having a device for locking the skate structure at the desired length, with structural and functional characteristics such as to overcome completely the disadvantages mentioned above with reference to the known art.

SUMMARY OF THE INVENTION

These and still further objects which will become more apparent in the following description, are achieved by a roller skate having a support structure basically constituted by two parts which are mutually telescopically engaged by a sliding coupling guided in the direction of extension of the skate, the skate having fixing means for securing said parts in fixed mutual positions corresponding to a desired skate length, said fixing means comprising:

(a) means defining on at least one section of one of the parts of the support structure, a plurality of notches aligned in the said direction of extension of the skate, (b) a central member guided in the other of the said parts of the support structure, for movement towards and away from the said at least one section provided with notches.

(c) at least one tooth provided on the central member and extending towards the said plurality of notches, (d) a presser member for moving the central member, against spring means, towards the section provided with notches.

In accordance with the preferred embodiment, the two parts of the support structure of the skate of this invention are mutually engaged by sliding couplings formed by cooperating prismatic guide elements which extend along the sides of the skate in positions substantially symmetrical relative to the longitudinal axis of the skate itself. One of the parts is formed along its two sides with respective toothed sections having transverse teeth which define respective transverse notches. The said central member is guided in the other support structure of the skate and is preferably constituted by a plate extending like a bridge relative to the two toothed sections mentioned above. This plate is in its turn provided with opposing toothing for simultaneously engaging the notches of the toothed sections of the first part of the support structure.

In particular and in accordance with a further characteristic of the invention, the presser member is constituted by a lever having one end in constant contact with the movable plate, this end being formed as a cam with a profile providing two stops for the movable plate.

BRIEF DESCRIPTION OF THE DRAWINGS

Further characteristics and advantages will become clearer from the detailed description of a preferred embodiment of an extendible roller skate according to the invention made below with reference to the appended drawings, given purely by way of non-limiting example, in which.

DESCRIPTION OF THE PREFERRED EMBODIMENT

Figure 1:
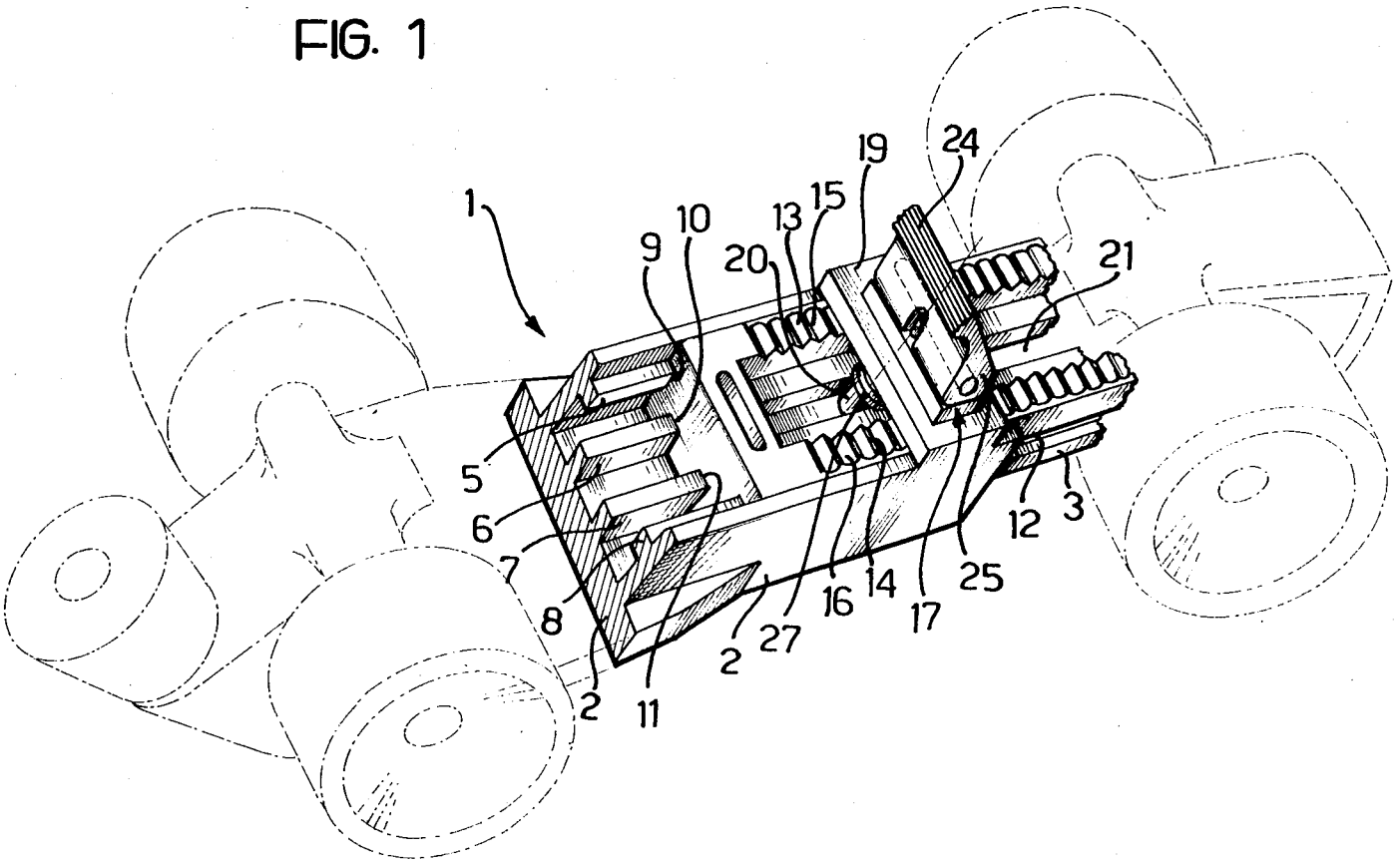
FIG. 1 is a schematic perspective view from below of a roller skate according to the invention.

With reference to the said drawings, an extendible skate generally indicated 1 has a support structure basically constituted by two parts 2, 3 which are mutually connected by a coupling slidable in the direction of extension of the skate, the coupling being implemented by cooperating prismatic guide elements. More particularly, part 2 of the support structure, which is basically box or female shaped, is formed with rectilinear guide elements 5,6, 7 and 8 which are in sliding engagement with corresponding guide elements 9, 10, 11 and 12 formed in the other part 3 of the support structure.

The part 3 is provided, along its two side portions extending parallel to the direction of extension of the skate, with respective pluralities of transverse teeth 13, 14 defining corresponding pluralities of transverse notches 15, 16.

A central member generally indicated 17, preferably constituted by a plate, is movably guided in an aperture 18 of complimentary dimensions formed in a cross member 19 of the part 2 of the skate support structure, this member 19 extending as a bridge across the other part 3 of the same structure. The plate-shaped central member 17 also extends like a bridge across the two pluralities of teeth 13, 14 mentioned above.

A pin 20 supported by part 2 of the support structure, extends through a longitudinal slot 21 in part 3 of the support structure and through a hole 22 formed centrally in the plate-shaped central member 17.

A second pin 23 is supported transversely by the pin 20 close to the free end 20*a* thereof and projects beyond the plate-shaped central member 17. A lever 24 is pivoted on the pin 23 and has one end 25 in constant contact with the plate-shaped central member 17.

More particularly, the head 25 of the lever 24 is cam shaped and its profile 26 includes two portions 26*a*, 26*b* which are spaced at different distances from the pin 23 and constitute two stops for the movable plate-shaped central member 17 as will become clearer from the description below. In particular, the distance of the portion 26*a* from the pin 23 is less than that of the portion 26*b* from the pin.

Furthermore the two portions 26*a*, 26*b* of the cam profile 26 are separated by an intermediate portion 26*c* which is substantially elbow shaped and includes the points of the cam profile furthest from the pin 23.

It should also be noted that, in accordance with a preferred but non-limiting embodiment, the portions 26*a*, 26*b* mentioned above are perpendicular to each other.

A spring 27 guided by the pin 20 on which it is coaxially mounted, resists the movement of the plate-shaped central member 17 towards part 2 of the support structure of the skate.

The wall of the plate-shaped central member 17 facing part 3 of the support structure of the skate, is formed with a plurality of teeth 28 arranged to simultaneously engage the notches 15 and 16 defined respectively by the pluralities of teeth 13, 14 of the part 3 of the support structure.

Such an engagement is required to mutually lock together the parts 2 and 3 of the support structure of the skate after their positioning in conformity with the desired length of the skate.

To effect said engagement, and also disengagement, of the teeth 28, 13 and 14, it is necessary to move the plate-shaped central member 17 towards and away from the part 3 of the support structure of the skate. It is these movements which are carried out by means of the lever 24.

Figure 2:
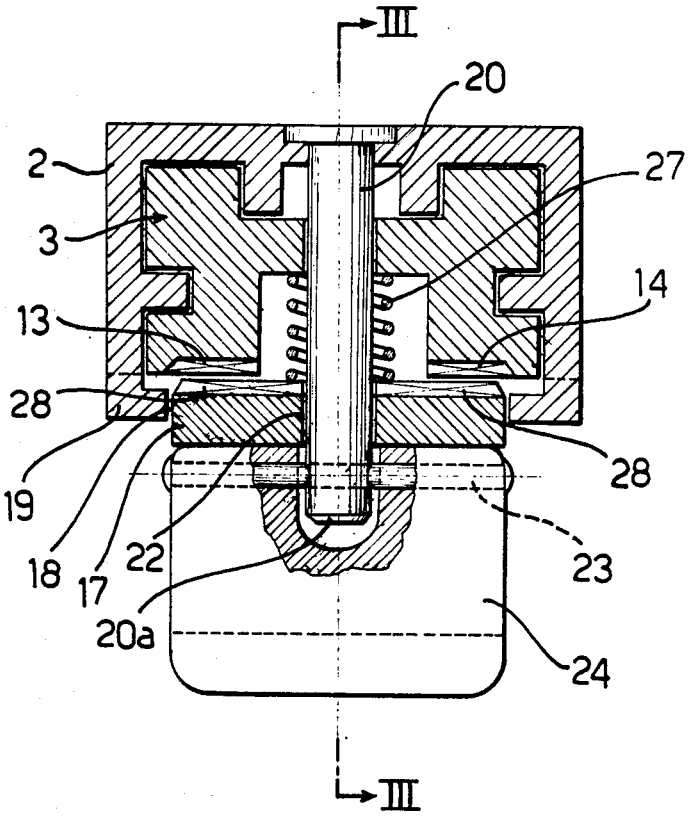
FIG. 2 is a cross sectional view of the skate of FIG. 1 on an enlarged scale.
Figure 3:
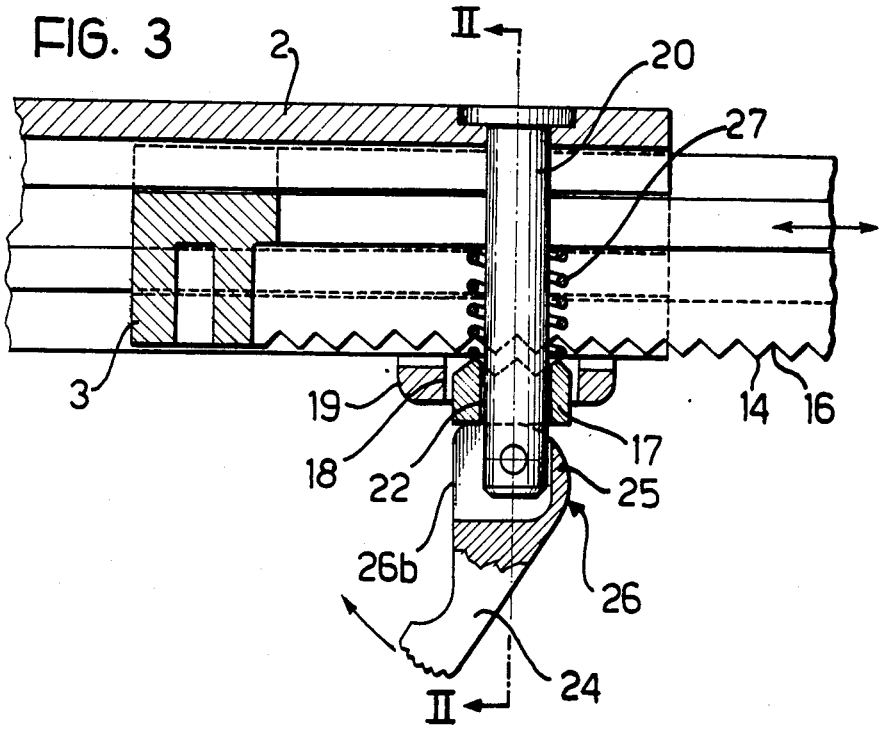
FIG. 3 is a sectional view taken on the line III—III of FIG. 2, still on an enlarged scale.

In the condition shown in FIGS. 2, 3, the lever 24 is angularly displaced about the axis of the pin 23 from a position in which the rectilinear portion 26*a* of the profile 26 of the cam-shaped end 25 of the lever, is in contact with the plate-shaped central member 17 (this contact is ensured by the spring 27).

In this condition, the teeth 28 of the plate-shaped central member 17 are spaced and disengaged from the plurality of notches 15, 16 of part 3 of the support structure of the skate. Consequently, the parts 2, 3 of the structure can easily be positioned relative to one another in order to achieve the desired skate length.

When this length is set, the lever 24 is displaced angularly about the pin 23 so as to bring the portion 26*b* of the profile 26 of the cam-shaped end 25 of the lever into contact with the plate-shaped central member 17. This angular displacement effects rectilinear displacement of the plate-shaped central member towards the support-structure part 3 with a consequent engagement of the teeth 28 of the central member with the pluralities of notches 15, 16 of the supportstructure part 2 (FIG. 4).

Figure 4:
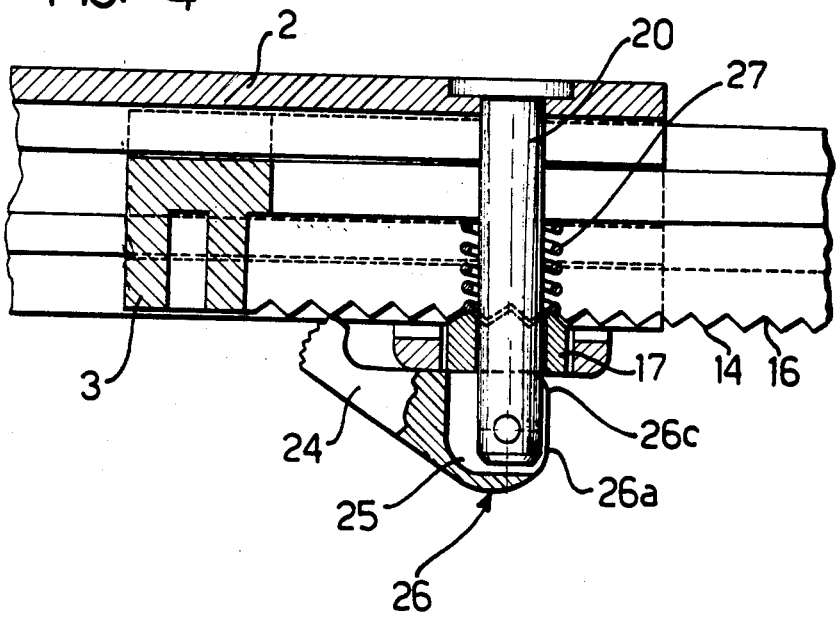
FIG. 4 is the same section as in FIG. 3 but in a different position of use of the skate according to the invention.

It should be noted that both the conditions shown in FIGS. 3 and FIG. 4 are stable conditions since the plate-shaped central member 17 bears against the rectilinear portions 26*a* and 26*b* of the cam-shaped end 25 of the lever 24, whereby the portions constitute stops for the displacements of the central member.

From what has been stated above and from the appended drawings it will be seen how the locking and unlocking device illustrated enables all the disadvantages mentioned with reference to the devices of the known art to be overcome.

In particular, the speed and ease of its operation and also the fact that its locking efficacy is ensured for a practically indefinite period of time, should be noted.

What is claimed is:

1. A roller skate extendible in its length direction and including a support structure formed by two parts which are coupled together for mutual telescopic movement in said length direction of the skate, and fixing means for securing said parts in fixed mutual positions corresponding to a desired length of said skate, said fixing means comprising:

a plurality of notches extending transverse to said length direction on at least one section of one of said parts;

a cross member affixed to the other of said parts and extending as a bridge transverse to the length direction of said skate, said cross member including an aperture extending therethrough;

a guide mounted on one of said parts and extending through said aperture;

a tooth member having a surface with at least one tooth slidably mounted on said guide and being adapted to be inserted into said aperture for engaging said plurality of notches to prevent telescopic movement between said two parts or retracted through said aperture to permit telescopic movement between said two parts;

resilient bias means for urging said tooth member away from said plurality of notches, said resilient bias means contacts and exerts pressure against said surface; and a cam lever operatively connected to said guide for selectively manually positioning said tooth member in a first position wherein said tooth member is lockingly inserted through said aperture and in engagement with said plurality of notches for preventing telescopic movement between said two parts or in a second position for enabling said resilient biasing means to bias said tooth member away from said plurality of notches to permit telescopic movement between said two parts;

whereby forces acting to disengage said two parts are applied directly to said cross member for ensuring operative engagement of said two parts when in the locked condition.

2. A roller skate extendible in its longitudinal direction and including:

a support structure formed by two parts provided with cooperating prismatic guide elements that extend along the sides of the skate in positions substantially symmetrical relative to the longitudinal axis of the skate, the guide elements of the two said parts of the support structure cooperating with each other to slidingly couple together said parts for mutual telescopic movement in said longitudinal directions, one of said parts being formed to define two pluralities of notches aligned along the sides of the bottom of the skate in the said longitudinal direction;

a cross member affixed to the other of said parts and extending as a bridge transverse to the length direction of said skate, said cross member including an aperture extending therethrough;

a guide mounted on one of said parts and extending through said aperture;

a movable plate having a notch engaging surface slidably mounted on said guide and being adapted to be inserted into said aperture for engaging said plurality of notches to prevent telescopic movement between said two parts or retracted through said aperture to permit telescopic movement between said two parts;

spring means bearing against said notch engaging surface and urging said plate away from said pluralities of notches; and a presser member operable to move said plate, against the action of said spring means, towards said pluralities of notches, said presser member being constituted by a lever having one end that is shaped as a cam and is in contact with, and acts upon, said plate, said cam-shaped end having a profile which defines two stops for the said movable plate for selectively manually positioning said plate in a first position wherein said plate is lockingly inserted through said aperture and in engagement with said plurality of notches for preventing telescopic movement between said two parts or in a second position for enabling said spring means to bias said plate away from said plurality of notches to permit telescopic movement between said two parts.

3. A roller skate according to claim 1, wherein said guide is a pin and said resilient bias means encircles said pin.

4. A roller skate according to claim 1, wherein said cam lever includes one end in constant contact with the toothed member, said end being formed as a cam with a profile providing two stops for the toothed member.

5. A roller skate according to claim 2, wherein said guide is a pin and said spring means encircles said pin.

6. A roller skate according to claim 1, and further including a support affixed to and extending transversely through said guide for mounting said cam lever.

7. A roller skate according to claim 2, and further including a support affixed to and extending transversely through said guide for mounting said presser member.

* * * * *